United States Patent [19]

Garro

[11] Patent Number: 4,711,108

[45] Date of Patent: Dec. 8, 1987

[54] COMBINATION LOCK

[76] Inventor: Jose P. Garro, Bo Ventas s/n. Carr., Oyarzun, Irun (Guipuzcoa), Spain

[21] Appl. No.: 878,395

[22] Filed: Jun. 19, 1986

Related U.S. Application Data

[63] Continuation of Ser. No. 510,083, Jun. 30, 1983, abandoned.

[30] Foreign Application Priority Data

Jun. 30, 1982 [ES] Spain ..... 513.592

[51] Int. Cl.[4] ..... E05B 37/02

[52] U.S. Cl. ..... 70/312; 70/316

[58] Field of Search ..... 70/312, 315–318, 70/69–74

[56] References Cited

U.S. PATENT DOCUMENTS

| | | | |
|---|---|---|---|
| 3,482,421 | 12/1969 | Franzen | 70/74 |
| 3,766,760 | 10/1973 | Mohrhauser et al. | 70/315 X |
| 3,800,571 | 4/1974 | Heine | 70/312 X |
| 4,100,775 | 7/1978 | Bako | 70/70 X |
| 4,123,923 | 11/1978 | Bako | 70/316 X |
| 4,327,566 | 4/1982 | Ling | 70/312 |
| 4,343,163 | 8/1982 | Scelba et al. | 70/71 X |
| 4,350,030 | 9/1982 | Broley | 70/70 |
| 4,356,712 | 11/1982 | Bako | 70/69 |
| 4,366,687 | 1/1983 | Atkinson | 70/316 X |
| 4,420,956 | 12/1983 | Li | 70/312 |
| 4,487,043 | 12/1984 | Milles | 70/316 X |
| 4,520,641 | 6/1985 | Bako | 70/312 |

FOREIGN PATENT DOCUMENTS

| | | | |
|---|---|---|---|
| 2085065 | 4/1982 | United Kingdom | 70/74 |

*Primary Examiner*—Robert L. Wolfe

*Attorney, Agent, or Firm*—Laff, Whitesel, Conte & Saret

[57] ABSTRACT

A combination lock having a selectable combination is provided wherein the combination cannot be changed when a case to which the lock is attached is closed. The lock has a slidable shaft with a plurality of sockets rotatable about said slidable shaft and the sockets are axially movable with the shaft and maintain their relative axial position on said shaft. There are a plurality of rollers connected to the sockets and each roller has one of the sockets associated therewith. The sockets and shaft are axially movable with respect to the rollers and rotating at least one roller relative to its associated socket varies the combination. The lock has an axially movable frame and a closer associated with the frame which can move the frame in one direction to open and close the case and in the other direction to place the lock in position to change the combination. Means are provided to restrain the frame in the combination changing position once the combination changing position has been attained and means to immobilize the operating means when the lock is in an off-key position.

5 Claims, 16 Drawing Figures

V
VII
1
2
8
9
11
12
13
14
15
19
20

COMBINATION LOCK

This is a continuation of U.S. patent application Ser. No. 06/510,083, filed Jun. 30, 1983, now abandoned.

The present specification has as its purpose the stating of the object for which there will be asked the priviledge of industrial and commerical exploitation, exclusively in the national territory, of a Patent of Invention, according to the Legislation in Force relative to Industrial Property which, as the statement indicates, relates to "A NEW SYSTEM FOR THE CHANGING OF KEY IN COMBINATION LOCKS".

As it is well known, combination locks are opened by the user correctly lining up, in a predetermined order a few concrete symbols such as numbers, which are engraved on the periphery of a few rollers or roulettes it. That arrangement makes it possible, in a reduced space and with a simple mechanism, to have a very secure closure because of the multiplicity of possible combinations and also because the lock obviously requires no key, avoiding problems of misplacement and of duplicating, etc., the key all of which results in a more convenient lock for the user.

Those advantages have made it possible to extend the combination lock to all fields, making them ideal for overnight bags, for cases or for similar elements, in which only a reduced space is provided for a dependable and secure lock mechanism which can be opened the user without failing. A usual arrangement in those locks is that wherein various rollers or roulettes are placed parallel, and in which appear, from the outside of each roller a single symbol which must be correct to produce the opening.

For reasons of fabrication and with the idea that each user can change the combination to a series of symbols which are easy to remember for him, those combination locks for overnight bags, for cases etc., should present a mechanism which make it possible to change the key combination (hereinafter referred to as the "key") in essence the mechanism consists of an element which provides the disengaging of the rollers; so that the rollers can position themselves according to the desired sequence of symbols which will be the one which determines the opening of the lock.

There are numerous forms known for obtaining a change of the key, the majority of which an element complementary to the mechanism, which may be located in the rear part of the lock, with its attendant problems. Alternately, it can be hidden (dissimulated) in the front face with the problem of an undesired handling, in any case the addition of one more element which complicates the fabrication and the operation of the lock and unequivocally indicates to potential thieves the main point of the closing mechanism.

The present invention has as its object a new system for the changing of key (combination) in which there exists no element in addition to those already normally used for the opening and the closing of the lock, wherein the rollers indicating the opening key can be operated in the direction opposite the conventional opening direction, causing the disengaging of the wheels so that they can be positioned in the new desired key, or combination.

To that end and coming now to the present system, the above mentioned device (pulsador) forms with a movable bolt a single part. Likewise, the unit formed is endowed with a few additional shapes which permit the disengaging motion. On the other hand, so that the entire unit will be kept back while the change of key or combination is carried out, the bolt itself is given shapes of a hook which together with a spring make possible changing key or combination.

That idea of duplicating the functions of elements already existing translates itself, as it solely by means of small physical changes translates itself, as it can be appreciated, in fundamental advantages in the simplicity of fabrication and of operation which ensures an important dependability to the lock at any time.

Furthermore, it is very important to emphasize that with the new system now advocated, when the individual components of the lock are disengaged or ready for the change of key or combination, they remain of themsleves stable, offering the user complete convenience and safety of handling for such a change.

In order better to understand the nature of the invention, in the attached drawing we are representing, as an example (which is illustrative only, and not limitative) one preferred form of execution of the invention, to which we are referring in our description of those figures.

Figures 5, 6, 7, 8, 8A:
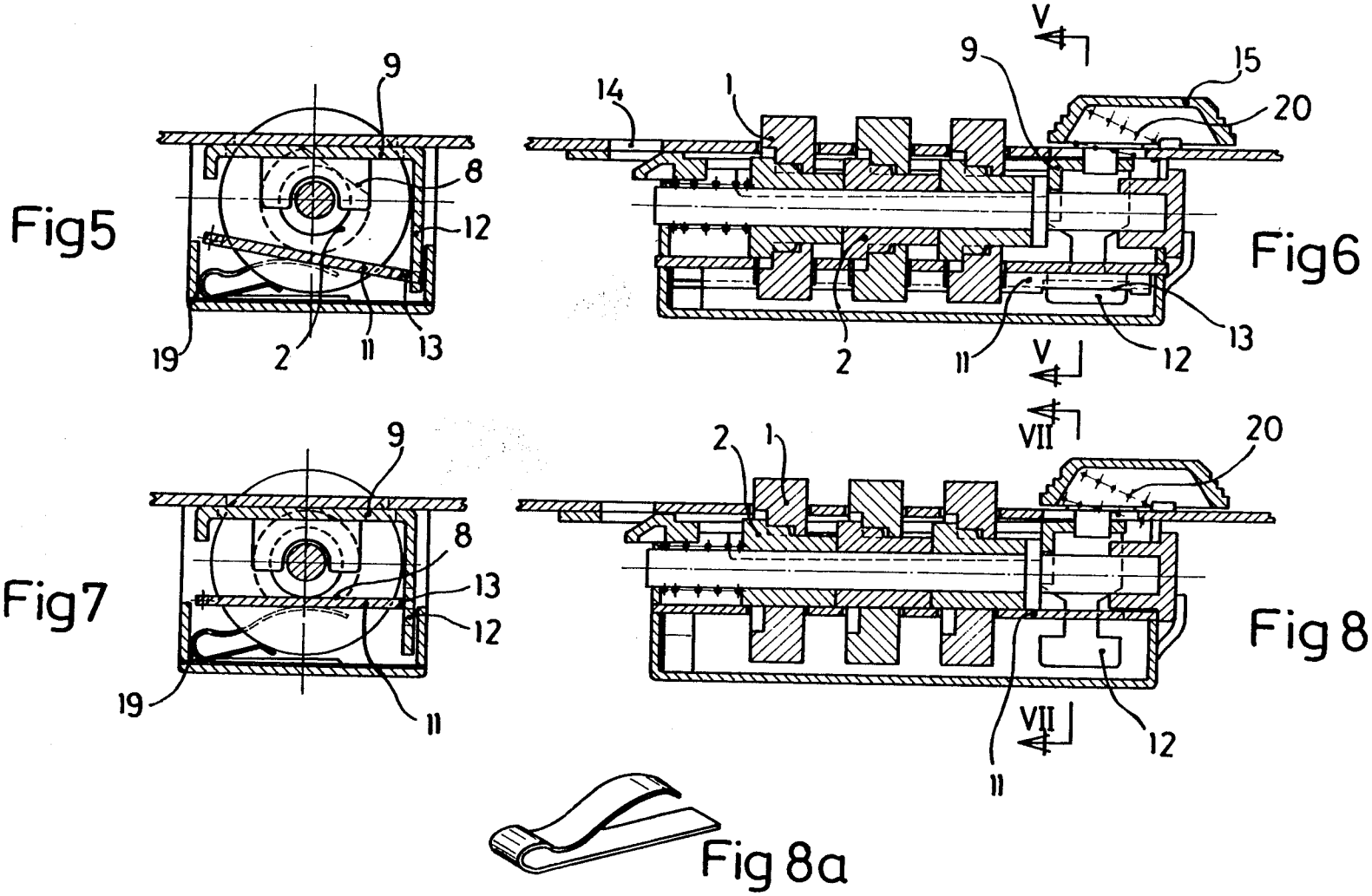
FIG. 5 is a profile view of the mechanism represented in FIG. 4, in a position which corresponds to the blocking position, and said profile view having been sectioned along a plant V—V indicated in FIG. 6.
FIG. 6 represents a front elevated view of the closing sectioned along its longitudinal median plane and in the same blocking position as in the preceding figure.
FIG. 7 represents a profile view sectioned along plane VII—VII indicated in FIG. 8, with the combination suitably located and the mechanism ready for opening.
FIG. 8 is the front elevated view as in FIG. 6, but with the mechanism in its free opening position.

FIG. 8A' indicates a detail of the elastic blade which maintains the oscillating bridge in its elevated position.

Figure 9:
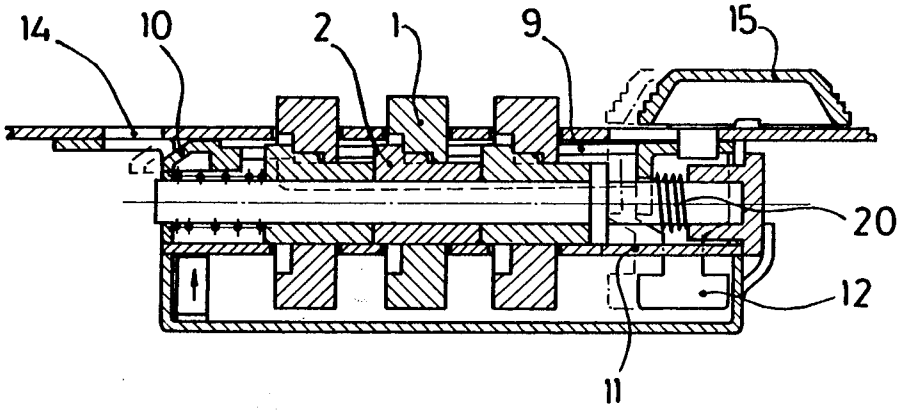

FIG. 9 represents a figure such as the preceding one, with a displacement of the opening device (pulsador) for opening.

Figure 10:
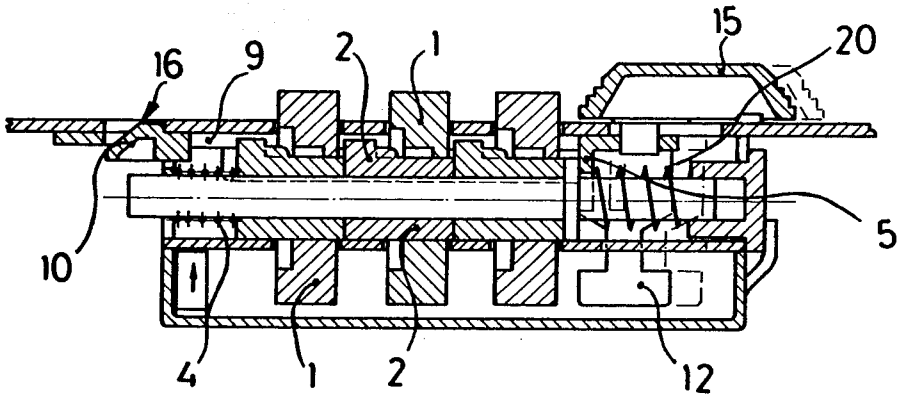

FIG. 10 is a view similar to that in FIG. 8, but in which the mechanism of opening device is moved in the direction opposite that of opening in order to produce the change of key (combination).

Figure 11:
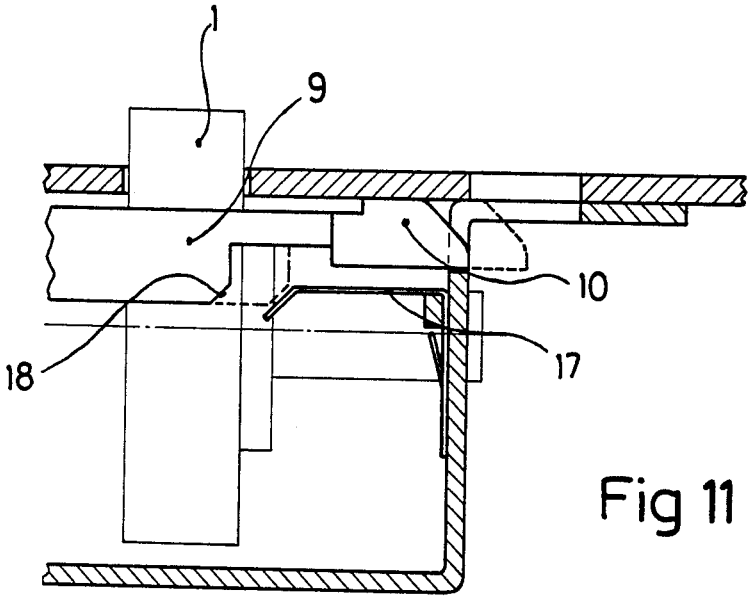
Figure 12:
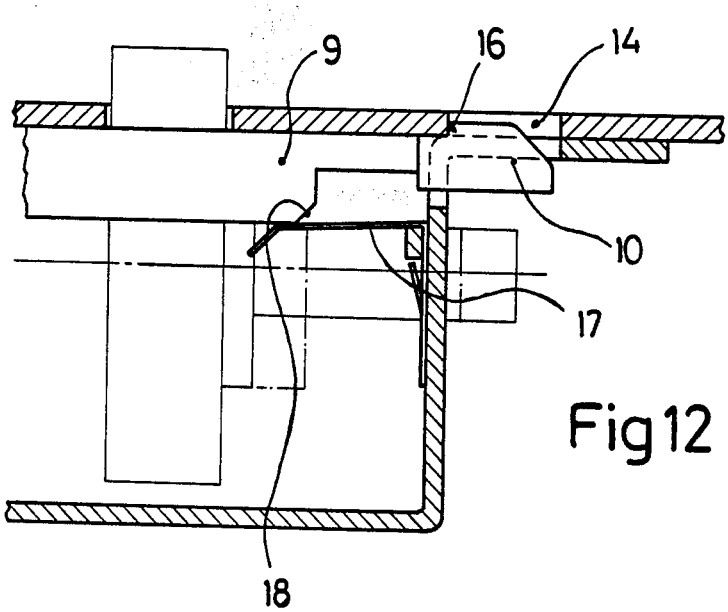

FIGS. 11 and 12 represent in enlarged manner a detail of the movement and position of the closing bolt in the respective cases of opening and change of key (combination).

Figure 13:
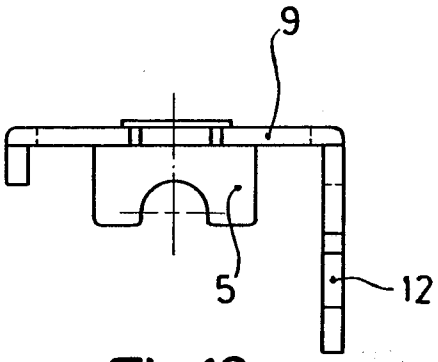

FIG. 13 represents a profile view of the monopart unit of bolt.

Figure 14:
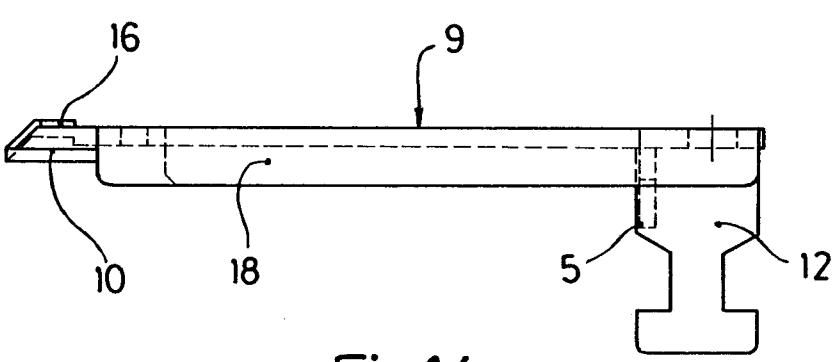

FIG. 14 represents an elevated view of the preceding Figure.

Figure 15:
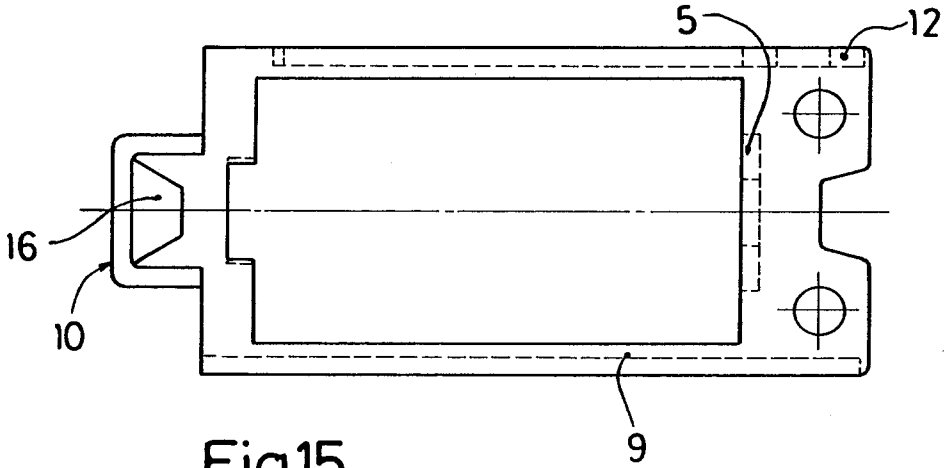

FIG. 15 represents top view of the sliding unit of the bolt.

The object of the present invention is a new system for the changing of the key (combination) in combination locks especially applicable to locks of small dimensions, such as those for overnight cases, for boxes, for suitcases, etc. These locks are formed of several rollers (roulettes) (1) bearing symbols on their periphery, and are located in parallel positions on a shaft and are such that they can rotate.

Figure 1:
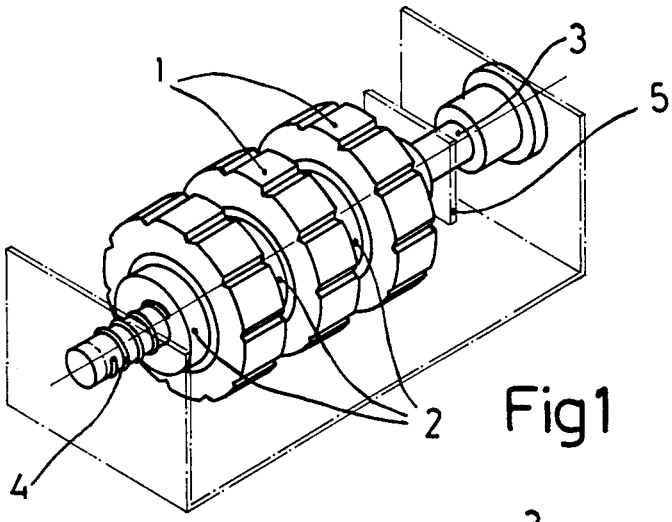
FIGS. 1 and 2 represent perspective views of the combination mechanism in its operational and in its disengaged positions.
Figure 2:
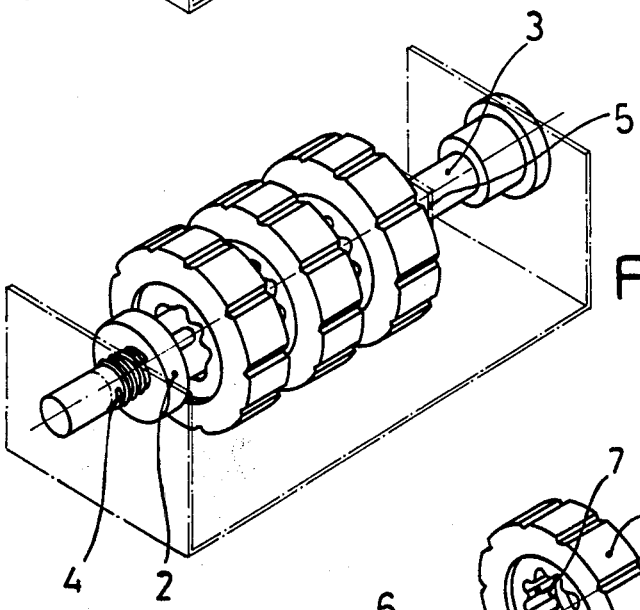

Before entering into the description of the invention and for the purpose of making said description clearer, there will be described, with reference to FIGS. 1, 2 and 3, the constitution of the combination elements of the lock and their possibilities of displacement, such aspects already in previous patents of applicant.

The rollers or roulettes (1) do not directly bear on shaft (3), but do so through engaging sockets (2) which present a larger diameter than shaft (3). In FIG. 3 it can be seen that sockets (2) also include a flanged end of greater diameter. This flanged end includes a flattened or grooved surface (8). All of those engaging sockets (2) maintain a fixed axial position because of the pressure of an end spring (4) which maintain them against a pusher (5). The axial positions of the rollers or roulettes (1), relative to shaft (3) remain the same since they protrude through windows of the closing plate (not shown) which maintain them in position.

Figure 3:
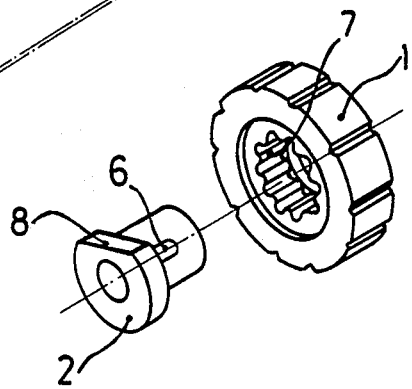
FIG. 3 represents, in perspective, a view of a roller or roulette (1) with its internal engaging socket.

As it may be seen in FIG. 3, the rollers or roulettes (1) present a toothed aperture (7). The number of teeth in aperture (7) is identical to or a multiple of the number of symbols existing on roller (1). Each socket (2) presents one radial projection (6) which enable the formation of a rotating single unit with roller (1) by engaging aperture (7) teeth. It can be seen that socket groove (8), in connection with roller (1) defines a flat. When all the flats formed by grooves (8) in their respective rollers (1) are lined up radially facing the same direction, the combination lock is in an "unlocked" configuration.

It is obvious that when the radial position of a roller or roulette (1) is changed, with respect to its engaging socket (2), there is a variation in the outside symbol which must be located so that each groove (8) will remain in the aforementioned unlocked position, which is to say that the combination or key of the lock has changed.

Therefore in order to obtain the change in combination, it is necessary first to obtain the disengaging of the rollers or roulettes (1) with their corresponding sockets (2). That step is represented in FIG. 2, and it consists in causing the displacement of pusher (5) in the axial direction against spring (4), thus displacing the sockets (2) and freeing the rollers or roulettes (1). Rollers (1) may then be manually repositioned in order to assume any new position which will be the new combination.

Figure 4:
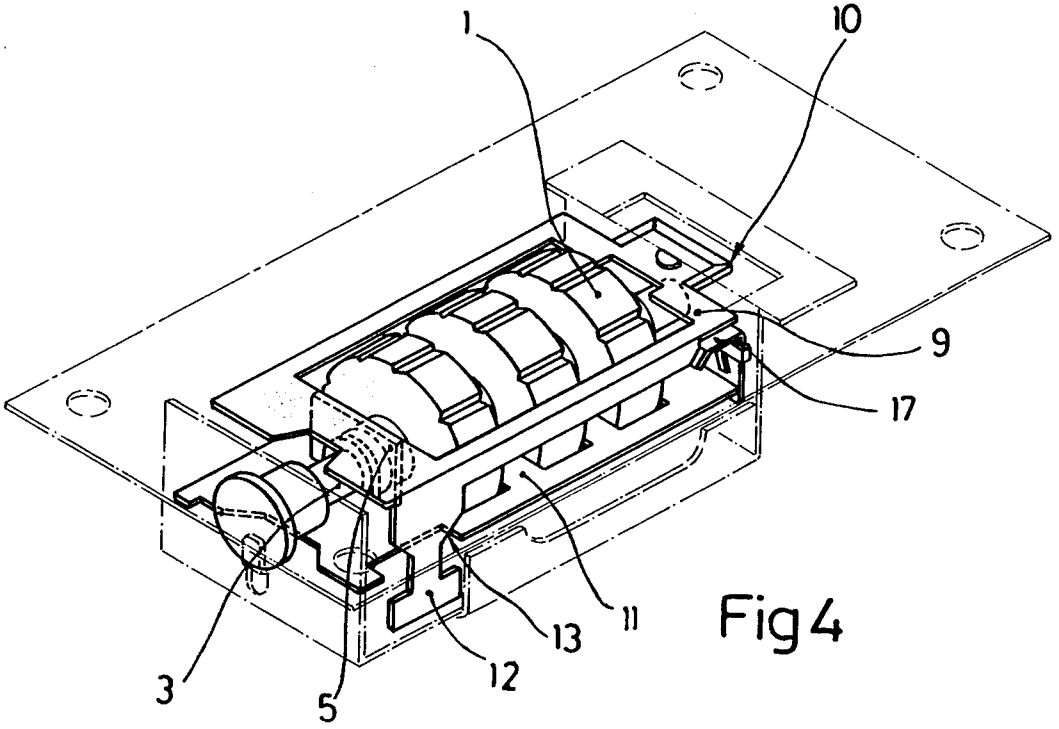
FIG. 4 represents a perspective view of one form of execution of the new system.

The idea of obtaining this displacement with only using existing elements of the lock, and without adding any additional device, is one of the objects of the new here-presented system. An alternate preferred form may be seen in FIG. 4, in which, in addition to rollers or roulettes (1), on shaft (3) and their corresponding sockets (2) there is seen an upper frame (9) which incorporates bolt (10) which is used for closing. Also seen is bridge member (11) which oscillates according to the positions of gooves (8) of sockets (2), which, depending on the position of grooves (8) may allow displacement of frame (9).

The interaction between frame (9) and the oscillating bridge (11) is produced through a prong (12) of frame (9) Prong (12) projects perpendicularly to frame (9) and is positioned within a lateral notch (13) of the oscillating bridge (11). As it may be seen in FIG. 4, prong (12) presents the shape of a double "T", around which notch (13) of the oscillating bridge (11) can place itself.

FIGS. 5 and 6 represent in section view the position of the various elements of the lock. It can be seen in FIG. 5 that at least one of the engaging sockets (2) has its groove (8) in a position and therefore forces bridge (11) to occupy a low position in which notch (13) fits on the wide lower part of prong (12). This causes frame (9) to be hindered in its motion dispite the fact that closing device (15) is otherwise free to be operated in any direction.

When rollers or roulettes (1) are placed in the correct succession of symbols forming the combination or key, the mechanism assumes the arrangement represented in FIGS. 7 and 8. In FIG. 7 can be seen that when in contact with the grooves (8), bridge (11) oscillates, and assumes a horizontal position. The position bridge (11) assumes represented in FIGS. 7 and 8 is also the level of notch (13) on the narrow part of prong (12) and therefore allows the possibility of motion for frame (9).

Said oscillating motion of oscillating bridge (11) which rests contiguously on grooves (8) is possible because in the box containing the mechanism, a curved elastic blade (19) made of one part is located. Blade (19) may be seen in FIG. 8*a*, and shows its straight arm which bears on the bottom of the box containing the mechanism, and its doubly curved arm which bears against the lower face of oscillating bridge (11).

If the closing device (15) moves, as represented in Figure (9), moving away from the opening of the lock (14), the entire frame (9) moves with it as they are solidary, and bolt (10) frees opening (14) to proceed to the opening of the lock.

That displacement of closing device (15) to cause the opening of the lock is done against an elastic element constituted by a spring (20) of the helix-shaped type. Spring (20) can be placed as represented in FIGS. 6 and 8 in the inside hollow part of the closing device (15) between closing device (15) and a central point protruding from the plate of the lock located under the shaft Similarly, spring (20) can be located in the manner represented in FIGS. 9 and 10, coaxially with shaft (3), bearing on the posterior face of pusher (5).

Now, because of the symmetrical shape of prong (12) and its central positioning inside the notch (13), closing device (15) can impact a displacement in the opposite direction, as represented in FIG. 10.

Moreover, considering that frame (9) forms a fork or pusher (5) abutting sockets (2), this displacement results in disengaging the rollers or roulettes (1) and their sockets (2) by an axial displacement of the sockets (2) against a spring (4) located on the shaft (3).

In any case, the tension produced by spring (20) will be inferior to that of spring (4), so that the express action of the user will be necessary to change the lock key. This is in spite of the fact that in the open position of the lock with the correct combination in position, spring (20) forces bolt (10) to occupy its closing position as represented in Figure (8).

Simultaneously with the disengaging illustrated in FIGS. 11 and 12. bolt (10) occupies a more forward position on the opening of the lock (opening 14), until projection (16) comes in positional correspondance with the opening. The projection (16) holds the entire mechanism, while in a safe and convenient manner the user chooses the new combination of the lock, after which the user pushes bolt (10) inwardly, causing through the action of spring (4) the entire unit to occupy a stable position, as represented in FIG. 8. The rollers or roulettes (8) then are turned to the position represented in FIG. 6, to leave the lock in operating position with its combination changed.

In FIG. 11 there can be seen in all details the usual positions during the operation of the bolt (10). In solid lines there is represented the open position, while in dotted lines there is represented the closing position of the bolt (10). It can be observed that in the closed position a bevel (18) of frame (9) is located facing the end of a flection spring 17.

When closing device (15) is operated in the direction opposite that of opening to obtain the combination change, spring (17) bends under the action of bevel (18) and pushes the entire frame (9) toward the closing plate, the result of which is putting projection (16) in opening (14). This lacks the unit which remains so as long as bolt (10) is not pressed downward against said spring (17).

It is thus made clear that this new system for the changing of the key or combination rests on elements already existing to which, through new concepts there has been given a multiple function for example, frame (9) which is represented in FIGS. 13, 14 and 15, and which in addition to a transporter of bolt (10), is a support for the pushing element (5), for the locking element (16) as well as allowing displacement relative to its prong (12), giving rise to a closing unit which is simpler both to fabricate and to operate, and more dependable, and which makes possible a reduction in size of the lock so that it can fit any need. Of no less import, such a system makes possible the change of key or of combination with complete convenience and safety, as it has available a mechanism which occupies a stable position in the disengagement phase.

The nature of the present invention having been sufficiently described, as well as its industrial form of execution, there only must be added that in its whole unit and in its constituting parts, it is possible to introduce changes in shape, in material used and in arrangement, without for as much leaving the scope of the present invention, as long as such changes do not remove its fundamental characteristics.

I claim:

1. A combination lock having a selectable combination comprising a slidable shaft, a plurality of sockets rotatable about said slidable shaft, said sockets being axially movable with said shaft and maintaining their relative axial position on said shaft, a plurality of rollers connected to said sockets wherein each roller has one of said sockets associated therewith, said sockets and said shaft being axially movable with respect to said rollers, said sockets normally coupled to the roller for common rotation therewith, and when said sockets are moved axially with respect to the rollers said rollers are rotatable about said sockets wherein rotating at least one roller relative to its associated socket varies the combination;

an axially movable frame, means attached to said frame to axially move said frame, said frame being movable when said lock is in an on-key position, said frame being movable in a first direction from a rest position to an unlocking position, said frame also movable in a second direction opposite said first direction from said rest position to a combination-changing position, said frame having means to axially move said slidable shaft and said sockets to disassociate said sockets from said rollers to permit the rotation of said rollers about said sockets and to permit the combination of said lock to be changed;

bolt means attached to the frame, said bolt means including projection means which restrains said frame in the combination changing position once said combination changing position has been attained; and prong means attached to said frame and engagable by an oscillating bridge means, said oscillating bridge means blocking said prong means when said lock is in an off-key position, wherein said operating means is rendered immobile in said rest position when said prong means is so blocked.

2. The combination lock of claim 1 wherein said sockets each provide a first and a second section, said first section being of smaller diameter than said second section, said second section including a flattened groove, said first section insertable within said rollers.

3. The combination lock of claim 2 wherein said oscillating bridge means includes a ladder-shaped planar bridge, said bridge being located beneath said slidable shaft and spring-biased upwardly.

4. The combination lock of claim 3 wherein said lock is on-key when each said groove is oriented downwardly, and said lock is off-key when said oscillating bridge is blocking said prong means rendering said operating means immobile.

5. The combination lock of claim 1, said projection means including a downwardly oriented beveled surface of a first end of said frame means rigidly attached to said bolt means, and upwardly biased spring means urging said bolt means upwardly when said frame is in said combination-changing position, wherein said projection means are releasably hooked into a fixed aperture, thereby restraining said operating means in said combination-changing position.

* * * * *